US005183497A

United States Patent [19]

Blenk et al.

[11] Patent Number: 5,183,497

[45] Date of Patent: Feb. 2, 1993

[54] IRON AND A COPPER SPEISS AS CO-ADDITIVES IN REFINING CRUDE LEAD BULLION

[75] Inventors: Michael H. Blenk, Youngstown, N.Y.; Russell B. Diemer, Jr., Hockessin, Del.; John P. Hager, Golden, Colo.

[73] Assignee: E. I. Du Pont de Nemours and Company, Wilmington, Del.

[21] Appl. No.: 835,646

[22] Filed: Feb. 13, 1992

[51] Int. Cl.[5] ..... C22B 13/06

[52] U.S. Cl. ..... 75/702

[58] Field of Search ..... 75/701, 702

[56] References Cited

U.S. PATENT DOCUMENTS

| | | | |
|---|---|---|---|
| 2,110,445 | 3/1938 | Lefferrer . | |
| 2,765,328 | 10/1956 | Padgitt . | |
| 4,033,761 | 7/1977 | De Martini et al. . | |
| 4,153,451 | 5/1979 | Crasto et al. . | |
| 4,333,763 | 6/1982 | Di Martini et al. . | |
| 4,404,026 | 9/1983 | Di Martini et al. . | |
| 5,100,466 | 3/1992 | Blenk | 75/702 |

FOREIGN PATENT DOCUMENTS

| | | | |
|---|---|---|---|
| 0007890 | 2/1980 | European Pat. Off. | 75/702 |
| 357245 | 1/1973 | U.S.S.R. . | |

OTHER PUBLICATIONS

"Sodium Treatment of Copper Dross", C. Bates and C. Di Martini Journal of Metals, Aug. 1986, pp. 43–45.

"Process for Separating Impurities from Crude Lead Bullion Via Sodium Metal Injection", M. B. Blenk, R. B. Diemer and J. P. Hager, Internal Symposium on Injection in Process Metallurgy, Feb. 21, 1991.

*Primary Examiner*—Melvyn J. Andrews

*Attorney, Agent, or Firm*—Charles E. Krukiel

[57] ABSTRACT

A process for using an iron-containing sulfide reagent and a previously formed copper speiss as joint co-additives to extend the usefulness of the sodium in refining crude bullion which has less than about 1.3 wt. % sulfur.

6 Claims, No Drawings

IRON AND A COPPER SPEISS AS CO-ADDITIVES IN REFINING CRUDE LEAD BULLION

BACKGROUND OF THE INVENTION

The present invention relates to an improved process for concentrating elemental lead in crude lead bullion, and, more particularly, to an improvement in such a process whereby sodium or a sodium-containing reagent is introduced into the molten crude bullion and the crude bullion contains less than about 1.3% by weight of sulfur as sulfide, the improvement comprising introducing iron or an iron-containing sulfide reagent and an amount of previously isolated copper speiss into the crude bullion either prior to or substantially simultaneously with the sodium whereby formation and separation of the matte, speiss and lead bullion equilibrium phases is enhanced. The isolated phases are (1) a low lead, low arsenic matte phase comprising primarily copper sulfide and sodium sulfide; (2) a low lead, high copper, high arsenic and iron speiss phase; and (3) a high lead, low sulfur, low arsenic, high silver lead bullion phase.

U.S. Pat. No. 4,404,026 describes a method for introducing sodium into molten crude lead bullion followed by controlled solidification to separate a matte phase and a copper speiss phase from the lead bullion phase. However, the ability of sodium to cause such beneficial separation of the equilibrium phases declines as the sulfur content of the crude bullion declines, usually to values below about 1.3% by weight. The mass of equilibrium phases formed can be too small for effective separation.

SUMMARY OF THE INVENTION

The present invention is a process for purifying lead bullion, i.e., concentrating elemental lead in the crude lead bullion, when the crude lead bullion contains less than about 1.3% by weight sulfur, generally as sulfide, which comprises:

(a) casting the molten bullion;

(b) cooling the cast bullion to form a partial matte crust over the surface thereof;

(c) introducing sodium or a sodium-containing reagent into the bullion;

(d) prior to or substantially simultaneously with the sodium, introducing an amount of iron or an iron-containing sulfide reagent into the bullion along with, either sequentially or simultaneously, an amount of previously isolated copper speiss, which can range from about 5% by weight up to about 10% by weight of the crude bullion; and (e) cooling the cast bullion to separate a matte phase and a speiss phase from the lead bullion phase.

The iron-containing sulfide reagent can be selected from the group consisting of iron disulfide ($FeS_2$), pyrite, marcasite, $Fe_{(0.8-1.0)}S$, pyrrhoyite, iron(II) sulfide, troilite, and iron(III) sulfide ($Fe_2S_3$). The previously isolated copper speiss acts to form a nucleation site for the speiss within the low-sulfur crude lead bullion being refined.

DETAILED DESCRIPTION OF THE INVENTION

The process for purifying crude lead bullion via sodium addition is described in U.S. Pat. No. 4,404,026, the teachings of which are incorporated herein by reference, and comprises casting molten bullion, generally at a temperature of about 1100°–1200° C.; cooling the cast bullion to a predetermined temperature, of about 750°–850° C., thus forming a partial matte crust over the surface of the bullion; adding a sodium-containing reagent beneath the surface of the bullion pool as to avoid an oxidation reaction of the sodium with air; then further cooling to solidify the matte and speiss to allow their separation from the lead bullion phase.

Crude lead bullion is obtained from a blast furnace and has been separated from ore slag. The composition of a typical crude lead bullion, based on samples from North American commercial lead refiners, is given in Table I.

TABLE I

Composition of a Typical Blast-Furnace Bullion Product (wt. %).

| | | | |
|---|---|---|---|
| Cu | 2.5–5.5 | As | 0.7–1.5 |
| Sb | 0.5–1.75 | S | 0.35–1.6 |
| Ag | 0.2–1.0 | Au | 0.0003–0.0006 |
| Pb | 65–95 | Fe | 0.1–0.8 |
| Zn | 0.05–0.2 | Sn | 0.04–0.17 |
| Bi | 0.1–0.5 | | |

The sodium addition process more effectively promotes beneficial separation in crude bullions which have more than 1.3 wt. % sulfur. When less sulfur is present the use of sodium to cause beneficial separation is limited by a lack of suitable reagent for the sodium to reduce and because the minimal production of non-bullion components makes isolation and recovery of those phases difficult. When a distinct speiss phase fails to form or is not isolatable, the bullion phase is poorly refined and retains high arsenic levels. A copper to lead ratio of greater than 3 and an arsenic level less than 2 wt. % in the matte phase indicates that the sodium treatment of the crude bullion has been efficient.

In the formation of the matte, speiss, and lead bullion phases, it is desired that certain elements be concentrated in particular phases in order to enhance the value and simplify further processing of each phase. The use of iron or iron sulfide reagents and previously isolated copper speiss with the sodium addition process enhances the beneficial separation of the matte, speiss, and lead bullion phases. Sulfur concentrates in the matte phase; copper, arsenic and iron concentrate in the speiss phase; and lead concentrates in the bullion phase. The added copper speiss is itself refined by the sodium present, its silver content moving toward the lead bullion phase. The use of co-additives also allows a lower dosage of sodium to be used while effecting a better separation of the equilibrium phases. In the matte phase, copper to lead ratios approaching and greater than about 4 and arsenic levels less than about 2 wt. % are attainable by the co-addition of an iron reagent and copper speiss to the sodium-addition process for crude bullions which contain less than 1.3 wt. % sulfur.

The amount of iron required is based on the amount necessary to convert all the arsenic to $Fe_2As$ and is termed a "stoichiometric iron requirement". The stoichiometric iron requirement is reduced by the amount of iron originally present in the crude bullion. From about 50% to about 100% of the stoichiometric requirement is used. Iron may be added as iron metal, iron disulfide ($FeS_2$), pyrite, marcasite, $Fe_{(0.8-1.0)}S$, pyrrhotite, iron (II) sulfide, troilite, or iron (III) sulfide ($Fe_2S_3$). The use of iron sulfide reagents increases the sodium stoichiometric requirement, as sodium must reduce the reagent before the iron is available to react with the arsenic. Therefore, while a sufficient amount of iron will reduce all the arsenic present in the system, the benefit of improved phase separation must be weighed against the economic penalty of increased sodium use when an iron sulfide reagent is used as the iron source. The equivalence of $Fe_{(0.8-1.0)}S$ and $Fe_2S_3$ to $FeS_2$ as speiss-promoting co-additives with sodium was developed using a thermochemistry model based upon the F*A*C*T routine available through McGill University. (F*A*C*T: Facility for the Analysis of Chemical Thermodynamics) The thermochemical model is described in International Symposium on Injection in Process Metallurgy; Ed. by T. Lehner, P. J. Koros, and V. Ramachandran; The Minerals, Metals, & Materials Society, Warrendale, PA, 1991; pg. 299-323; Library of Congress No. 90-64035; ISBN 0-87339-163-2.

The addition of iron to crude lead bullion causes a series of desirable reactions to occur. For pyrite, the sodium metal first reduces the pyrite to form sodium sulfide ($Na_2S$) and liberate iron. The iron, in turn reacts with any arsenic present to form $Fe_2As$, which becomes part of the speiss phase.

In systems which are low in arsenic, the amount of speiss formed may be small and difficult to isolate. In these systems a non-molten, iron-bearing phase may precipitate from solution hindering equilibrium phase separation. This phase can also hinder the beneficial partitioning of the components by encapsulating non-bullion components, including the unreacted iron sulfide reagent.

An iron-containing reagent would be combined with the crude bullion prior to the sodium addition. In a commercial practice, the iron-containing reagent would be added to a cast mold prior to the casting of the crude bullion in order to effect mixing of the iron reagent with the bullion. Alternatively, it may be possible to add the iron-containing reagent at the same time as the sodium. If iron metal were to be used, the blast furnace charge could be adjusted to increase the iron metal level. This route, however, is limited by the solubility of the iron in the bullion at blast-furnace temperatures.

Copper speiss may be obtained from a dross reverberatory furnace or be recycled from a sodium addition process. The composition of a typical copper speiss from a dross reverberatory furnace, based on samples from North American commercial lead refiners, is given in Table II.

TABLE II

Composition of a Typical Copper Speiss (wt. %)

| | | | |
|---|---|---|---|
| Cu | 40-60 | As | 12-25 |
| Sb | 0.5-12.0 | S | 0.1-5.0 |
| Ag | 0.1-3.0 | Na | 0.01-0.5 |
| Pb | 5-25 | Fe | 0.5-2.0 |
| Zn | 0.05-1.0 | Sn | 0.10-3.0 |
| Bi | 0.01-0.10 | Au | 0.0005-0.0100 |

From at least about 5 wt. % up to about 10 wt. % of previously isolated copper speiss is added to the crude bullion to promote speiss phase formation. When less than this amount is used, the resulting speiss phase may not be sufficiently isolatable. The added copper speiss forms a nucleation site for the relatively small amount of speiss which would otherwise form from the equilibrating system, thus promoting the separation of a speiss which is high in copper and arsenic and low in sulfur. While about 10 wt. % of previously isolated copper speiss, as an upper limit, is a sufficient quantity to promote speiss phase formation, more than 10 wt. % may be added, particularly if it is added in order to effect its further refinement. The copper speiss is combined with the crude bullion prior to the sodium addition. In a commercial practice, copper speiss would be added to a cast mold prior to the casting of the crude bullion in order to effect mixing of the copper speiss with the bullion. Alternatively, it may be possible to add the previously isolated copper speiss at the same time as the sodium.

The amount of sodium required is based on the amount necessary to convert all the sulfur (from PbS) and antimony to $Na_2S$ and $Na_3Sb$, respectively, and is termed a "stoichiometric sodium requirement". If no iron is used in treatment of the crude bullion, then the amount of sodium also includes the amount necessary to account for the arsenic. The stoichiometric sodium requirement is reduced by the amount of copper originally present in the crude bullion. The suggested level of sodium use when co-adding copper speiss is about 50% to about 100% of the stoichiometric sodium requirement, although as much as 120% may be used. Use of sodium in excess of the stoichiometric requirement enhances the fluidity of the matte phase, but system economics penalize excess sodium use. The use of previously isolated copper speiss allows a lower sodium dosage to effect the phase separation than is required by using sodium alone. The sodium-containing reagent may be metallic sodium, or $Na_2CO_3$, either alone or with coke, or may be a reagent which is chemically equivalent to a sodium containing reagent, such as, for example, a reactive metal mixture intermediate by-product comprising sodium and calcium as described in U.S. patent application Ser. No. 07/693,852 filed May 2, 1991, and allowed Oct. 21, 1991, the teachings of which are incorporated herein by reference.

The sodium-containing reagent should be added to crude bullion which is at a temperature above about 750° C. At temperatures below about 750° C. generally not all phases are liquid, and phase disengagement will be hampered. At 800° C., the speiss is more effective in attracting copper, arsenic, antimony, and iron. Partitioning of the other elements is not greatly different at 750° C. versus 800° C. When sodium metal is used, it is desirable to add the sodium to crude bullion which is at temperatures below about 850° C. to prevent flashing sodium vapor for both safety and efficiency reasons. As long as the sodium metal is injected beneath the surface of the bullion, temperatures as high as 870° C., i.e. below the boiling point of sodium (881° C.) may be feasible because the sodium appears to dissolve quickly in the bullion, and sodium reaction with other species may be rapid compared to loss via volatilization. Other sodium-containing reagents may be added to the crude bullion at higher temperatures because the sodium liberated by the reagent reacts very quickly with the lead bullion. Sodium metal may be added to the crude bullion in the solid or molten state. In either case the sodium metal is injected below the surface of the crust which forms on the top of the crude bullion, to prevent the oxidation of sodium with air. When sodium metal is added in the molten state, its temperature is kept below its auto-ignition temperature of 120°-125° C. in accordance with standard handling practices for sodium metal. Sodium-containing reagents, other than sodium metal, would be added to the crude bullion in a manner similar to the procedures used for a reverberatory furnace.

After cooling the treated crude bullion to about 350°–400° C., the matte and speiss phases are separated for further processing. The lead bullion phase is the ready for further refining.

EXAMPLE 1

The pyrometallurgical laboratory experiment was conducted in a crucible containing approximately 1902 grams of crude bullion the composition of which is shown in Table III. The granulated crude bullion was placed in a graphite crucible and then brought to 900° C. in a stainless steel reactor within an electrically heated furnace. The temperature was maintained at 900° C. for one hour to simulate blast furnace exit conditions and encourage homogenization of the sample. After one hour, the sample temperature was lowered to 800° C. and a stainless steel probe was lowered such that its tip was below the surface of the melt. Cast rods of sodium metal, a total of 23.5 grams, were injected below the surface of the melt by means of a pure lead slug follower, 104.0 grams, within the injection probe. After injection, the probe was withdrawn and the system was allowed 5 hours to equilibrate at 800° C. At the completion of the test, the furnace was opened and the reactor system was shock cooled via external cold air flow in order to preserve equilibrium phase compositions. After cooling, the test specimen was removed from the crucible, separated into its component phases, and analyzed for composition.

TABLE III

| Crude Bullion (wt. %) | | | |
|---|---|---|---|
| Cu | 3.72 | As | 1.07 |
| Sb | 1.24 | S | 0.687 |
| Ag | 0.608 | Na | 0.004 |
| Pb | 92.34 | Fe | 0.115 |
| Zn | 0.130 | Sn | 0.08 |
| Au | 0.0058 | | |

In each example the targeted amount for sodium addition was 100% of the stoichiometric requirement. The variations between the actual stoichiometric requirement used in each example would not be expected to yield results which would be statistically or functionally different.

For all examples the data reported has been normalized on the basis of crude bullion weight charged, so that the weights of phases recovered are more easily compared. The total data set was also subjected to a mass balance closure routine which utilized perturbations of optimize closure of the total material balance and all elemental balances. The resulting data set, in effect, accounts for documented experimental losses in handling the phases. The relationship of the examples and the formation of the equilibrium phases is shown in Table IV. In Table V the post-test equilibrium phase composition is compared for the examples. The elemental distribution between the phases for the Examples is given in Table VI.

In Example 1, sodium was added in an amount which was 100.6% of the stoichiometric amount necessary to react with all sulfur, arsenic, and antimony not already capable of being compounded with the copper present in the crude bullion. This corresponded to 1.16 wt. % sodium in the starting crucible. After 5 hours three equilibrium phases did form, although the amount of speiss phase was modest. Residual copper and arsenic in the bullion was high, and its lead content was 96.91 wt. %.

TABLE IV

| | Equilibrium Phases (Grams) | | | |
|---|---|---|---|---|
| Phase | Example 1 Na | Example 2 Na + $FeS_2$ | Example 3 Na+ Cu Speiss | Example 4 Na + $FeS_2$ +Cu Speiss |
| Matte | 76.1 | 156.0 | 74.0 | 128.0 |
| Speiss | 43.3 | 35.6 | 156.3 | 258.5 |
| Bullion | 1910.1 | 2065.0 | 1933.8 | 1972.3 |

TABLE V

| | Equilibrium Phase Compositions (wt. %) | | | |
|---|---|---|---|---|
| | Example 1 | Example 2 | Example 3 | Example 4 |
| MATTE | | | | |
| Copper | 25.4 | 16.3 | 27.8 | 19.8 |
| Arsenic | 0.38 | 5.53 | 0.25 | 2.0 |
| Antimony | 0.119 | 0.189 | 0.108 | 0.26 |
| Sulfur | 16.8 | 25.6 | 18.4 | 33.1 |
| Silver | 0.06 | 0.05 | 0.08 | 0.04 |
| Sodium | 29.6 | 30.0 | 30.6 | 38.6 |
| Lead | 1.80 | 3.50 | 2.90 | 1.62 |
| Iron | 1.92 | 10.5 | 2.08 | 8.40 |
| Zinc | 3.19 | 1.43 | 3.34 | 1.73 |
| Tin | 0.068 | 0.06 | 0.07 | 0.06 |
| Gold (ppm) | 1.98 | 7.0 | 1.96 | 4.64 |
| SPEISS | | | | |
| Copper | 50.6 | 16.0 | 59.2 | 38.5 |
| Arsenic | 24.29 | 11.6 | 22.3 | 14.1 |
| Antimony | 6.63 | 0.53 | 7.29 | 8.38 |
| Sulfur | 0.220 | 13.5 | 0.149 | 1.46 |
| Silver | 0.18 | 0.10 | 0.593 | 0.462 |
| Sodium | 0.205 | 12.5 | 0.141 | 1.41 |
| Lead | 15.2 | 14.2 | 13.2 | 12.4 |
| Iron | 1.64 | 28.4 | 0.983 | 7.67 |
| Zinc | 0.04 | 0.637 | 0.028 | 0.105 |
| Tin | 0.62 | 0.09 | 0.29 | 0.15 |
| Gold (ppm) | 78.2 | 17.8 | 104.2 | 138.8 |
| BULLION | | | | |
| Copper | 1.54 | 1.92 | 1.26 | 0.648 |
| Arsenic | 0.45 | 0.32 | 0.32 | 0.11 |
| Antimony | 1.09 | 1.13 | 1.36 | 0.79 |
| Sulfur | 0.010 | 0.033 | 0.010 | 0.011 |
| Silver | 0.595 | 0.552 | 0.645 | 0.621 |
| Sodium | 0.049 | 0.076 | 0.052 | 0.006 |
| Lead | 96.91 | 96.23 | 96.24 | 98.99 |
| Iron | 0.001 | 0.190 | 0.001 | 0.038 |
| Zinc | 0.001 | 0.002 | 0.001 | 0.002 |
| Tin | 0.064 | 0.07 | 0.08 | 0.08 |
| Gold (ppm) | 56.2 | 51.8 | 53.8 | 41.9 |

TABLE VI

| | Elemental Distributions Between Phases (%) | | | |
|---|---|---|---|---|
| | Example 1 | Example 2 | Example 3 | Example 4 |
| COPPER | | | | |
| Matte | 27.4 | 35.9 | 14.9 | 18.4 |
| Speiss | 31.0 | 8.0 | 67.3 | 72.3 |
| Bullion | 41.6 | 56.1 | 17.8 | 9.3 |
| ARSENIC | | | | |
| Matte | 1.4 | 44.4 | 0.4 | 6.2 |
| Speiss | 52.0 | 21.2 | 84.4 | 88.6 |
| Bullion | 46.6 | 34.4 | 15.1 | 5.2 |
| ANTIMONY | | | | |
| Matte | 0.4 | 1.2 | 0.2 | 0.9 |
| Speiss | 12.1 | 0.8 | 30.2 | 57.6 |
| Bullion | 87.5 | 98.0 | 69.6 | 41.5 |
| SULFUR | | | | |
| Matte | 97.8 | 87.9 | 97.0 | 91.4 |
| Speiss | 0.7 | 10.6 | 1.7 | 8.1 |
| Bullion | 1.5 | 1.5 | 1.4 | 0.5 |
| SILVER | | | | |
| Matte | 0.4 | 0.7 | 0.4 | 0.4 |
| Speiss | 0.7 | 0.3 | 6.9 | 8.8 |
| Bullion | 98.9 | 99.0 | 92.7 | 90.8 |

TABLE VI-continued

| | Elemental Distributions Between Phases (%) | | | |
|---|---|---|---|---|
| | Example 1 | Example 2 | Example 3 | Example 4 |
| SODIUM | | | | |
| Matte | 95.6 | 88.6 | 94.8 | 92.9 |
| Speiss | 0.4 | 8.4 | 0.9 | 6.9 |
| Bullion | 4.0 | 3.0 | 4.2 | 0.2 |
| LEAD | | | | |
| Matte | 0.1 | 0.3 | 0.1 | 0.1 |
| Speiss | 0.4 | 0.3 | 1.1 | 1.6 |
| Bullion | 99.6 | 99.5 | 98.8 | 98.3 |
| IRON | | | | |
| Matte | 66.7 | 53.9 | 49.7 | 34.3 |
| Speiss | 32.4 | 33.2 | 49.7 | 63.3 |
| Bullion | 0.9 | 12.9 | 0.6 | 2.4 |
| ZINC | | | | |
| Matte | 98.5 | 89.3 | 97.5 | 87.7 |
| Speiss | 0.7 | 9.1 | 1.7 | 10.7 |
| Bullion | 0.8 | 1.7 | 0.8 | 1.6 |
| TIN | | | | |
| Matte | 3.3 | 6.5 | 2.4 | 3.5 |
| Speiss | 17.3 | 2.0 | 21.5 | 18.1 |
| Bullion | 79.3 | 91.5 | 76.1 | 78.4 |
| GOLD | | | | |
| Matte | 0.1 | 1.0 | 0.1 | 0.5 |
| Speiss | 3.1 | 0.6 | 13.5 | 30.1 |
| Bullion | 96.8 | 98.4 | 86.4 | 69.4 |

EXAMPLE 2

In this example, iron pyrite was used to demonstrate the effect of iron co-addition in the sodium addition process.

Example 2 was carried out in the same fashion as in Example 1 with the following exceptions. A sample of the same crude bullion, about 1902 grams, shown in Table III was used. A total of 52.7 grams of sodium metal and a lead slug of 241.1 grams was used. Pyrite, 60.5 grams, was mixed with the crude bullion prior to heating. Sodium was added in an amount which was 99.8% of the stoichiometric amount necessary to react with all antimony and sulfur, including that from the pyrite, not already capable of being compounded with the copper present in the crude bullion. This corresponded to 2.34 wt. % sodium in the starting crucible.

The co-addition of iron with sodium had been found beneficial in previous work. In this example an iron-bearing phase precipitated from solution, presenting a layer which was not a true molten, well defined speiss phase. Although some arsenic was drawn to this iron/-speiss phase, both copper and arsenic in the bullion remained high and its purity (lead content by wt. %) was low. The matte had a significant arsenic burden, and contained considerable iron and lead.

EXAMPLE 3

In this example, previously formed copper speiss was used to demonstrate the effect of copper speiss co-addition in the sodium addition process.

Example 3 was carried out in the same fashion as in Example 1 with the following exceptions. A sample of the same crude bullion, about 1902 grams, shown in Table III was used. A total of 23.6 grams of sodium metal and a lead slug of 113.0 grams was used. The copper speiss, 125.5 grams, was mixed with the crude bullion prior to heating. The composition of the copper speiss is given in Table VII. The copper speiss was secured from a reverberatory furnace of a commercial lead refiner.

TABLE VII

| Composition of Copper Speiss (wt. %) | | | |
|---|---|---|---|
| Cu | 53.3 | As | 16.7 |
| Sb | 11.2 | S | 0.771 |
| Ag | 1.57 | Na | 0.172 |
| Pb | 10.4 | Fe | 0.715 |
| Zn | 0.047 | Sn | 0.45 |
| Au | 0.0079 | | |

Sodium was added in an amount which was 100.7% of the stoichiometric amount necessary to react with all sulfur, antimony and arsenic not already capable of being compounded with the copper present in the crude bullion. This corresponded to 1.09 wt. % sodium in the starting crucible.

After equilibrium, three well defined phases formed. The speiss phase formed weighed 30.8 grams more than the speiss originally charged to the system. This indicated both a preservation of the co-added speiss and an augmentation of its mass as it provided a nucleation site for additional speiss formation. The added copper speiss appears to have been refined by the action of the sodium as well. Speiss phase copper and arsenic levels have increased, while silver and antimony levels have fallen. The refined bullion phase purity (lead content by wt. %) improved with treatment, and the residual arsenic decreased.

EXAMPLE 4

In this example, pyrite and previously formed copper speiss were used to demonstrate the synergistic effect which results from iron and copper speiss coaddition according to the invention in the sodium addition process.

Example 4 was carried out in the same fashion as in Example 1 with the following exceptions. A sample of the same crude bullion, about 1902 grams, shown in Table III was used. A total of 52.8 grams of sodium metal and a lead slug of 218.7 grams was used. The pyrite, 60.5 grams, and copper speiss, 125.3 grams, was mixed with the crude bullion prior to heating. The composition of the copper speiss is given in Table VII. Sodium was added in an amount which was 99.8% of the stoichiometric amount necessary to react with all antimony and sulfur, including that from the pyrite, not already capable of being compounded with the copper present in the crude bullion. This corresponded to 2.2 wt. % sodium in the starting crucible.

After equilibration, the crucible showed formation of three equilibrium phases with sharper partitioning of several key elements between these phases. The bullion contained low levels of residual copper and arsenic, and overall lead content in the lead bullion phase improved to 99 wt. %. The silver content in the lead bullion phase increased suggesting that the sodium refined the copper speiss charged to the system. Silver, antimony, and copper were the only significant impurities remaining in the refined lead bullion phase. The sodium level in the lead bullion phase was virtually nil, attesting to the efficient utilization of alkali metal charged.

The matte phase produced when both co-additives are used is especially high in sulfur and sodium, and retains very little silver. The speiss phase produced remains predominantly a copper speiss, although iron is present in both the matte and speiss. The sulfur level of the speiss is relatively low. The speiss phase appears to attract some of the gold from the lead bullion phase.

We claim:

1. A process for concentrating elemental lead in molten crude lead bullion, in which the crude lead bullion contains less than about 1.3% by weight sulfur, which comprises:

(a) casting the molten bullion at a temperature in the range of from about 1100° C. to about 1200° C.;

(b) cooling the cast bullion to a temperature in the range of from about 750° C. up to a value which is less than the boiling point of sodium whereby to form a partial matte crust over the surface thereof;

(c) introducing sodium or a sodium-containing reagent into the bullion;

(d) prior to or substantially simultaneously with the sodium, introducing an amount of iron metal or an iron-containing sulfide reagent into the crude lead bullion which is in the range of from about 50% up to about 100% of the stoichiometric iron requirement based on the concentration of arsenic in the bullion;

(e) prior to or substantially simultaneously with the sodium, introducing an amount of previously isolated copper speiss into the crude lead bullion which is at least about 5% by weight of the bullion; and (f) cooling the cast bullion to separate a matte phase and a speiss phase from the lead bullion phase.

2. The process of claim 1 in which the iron-containing sulfide reagent is selected from iron disulfide ($FeS_2$), pyrite, or marcasite.

3. The process of claim 1 in which the iron-containing sulfide reagent is selected from $Fe_{(0.8-1.0)}S$, pyrrhoyite, iron(II) sulfide, or troilite.

4. The process of claim 1 in which the iron-containing sulfide reagent is iron(III) sulfide ($Fe_2S_3$).

5. The process of claim 1 in which the amount of previously isolated copper speiss added to the crude lead bullion is in the range of from about 5% by weight up to about 10% by weight of the bullion.

6. The process as claimed in claim 1 wherein the previously formed copper speiss has the following compositions (by weight):

| | | | |
|---|---|---|---|
| Cu | 40–60 | As | 12–25 |
| Sb | 0.5–12.0 | S | 0.1–5.0 |
| Ag | 0.1–3.0 | Na | 0.01–0.5 |
| Pb | 5–25 | Fe | 0.5–2.0 |
| Zn | 0.05–1.0 | Sn | 0.10–3.0 |
| Bi | 0.01–0.10 | Au | 0.0005–0.0100 |

* * * * *